US005230375A

United States Patent [19]

Linder

[11] Patent Number: 5,230,375

[45] Date of Patent: Jul. 27, 1993

[54] CURTAIN SYSTEM AND METHOD

[76] Inventor: Jill K. Linder, 867 Ravinia Ct., Batavia, Ill. 60510

[21] Appl. No.: 874,189

[22] Filed: Apr. 27, 1992

[51] Int. Cl.[5] ..... E06B 9/00

[52] U.S. Cl. ..... 160/39; 160/348

[58] Field of Search ..... 160/38, 19, 39, 330, 160/348, 327, 354, 370.2, 368.1, 405

[56] References Cited

U.S. PATENT DOCUMENTS

| | | | |
|---|---|---|---|
| 2,528,652 | 11/1950 | Gundlach | 160/348 |
| 3,996,987 | 12/1976 | Rodriguez | 160/38 X |
| 4,790,591 | 12/1988 | Miller | 160/370.2 |
| 4,862,943 | 9/1989 | Shafia | 160/370.2 |
| 4,922,600 | 5/1990 | Peters | 160/39 X |
| 4,955,419 | 9/1990 | Morris | 160/38 |
| 5,044,418 | 9/1991 | Donahue | 160/330 |
| 5,063,985 | 11/1991 | Bozzo | 160/330 |
| 5,074,348 | 11/1991 | Phillips | 160/38 |
| 5,092,384 | 3/1992 | Easley | 160/38 |

*Primary Examiner*—David M. Purol

*Attorney, Agent, or Firm*—Damian G. Wasserbauer

[57] ABSTRACT

A decorative valance system using an elastic member to provide shirring and adjustable width including a panel of fabric with upper and lower edges and a pair of opposite end, folded and joined together in a seam at the upper and lower edges to form front and back panel segments being disposed along the seam and secured adjacent to the opposite ends of the panel of fabric, and also having hook and mesh fabric secured adjacent the seam for attaching the panel to an opening in a wall. The panel of fabric being shirred by said elastic member to form a decorative ruffled or poufed appearance.

16 Claims, 3 Drawing Sheets

FIG.8
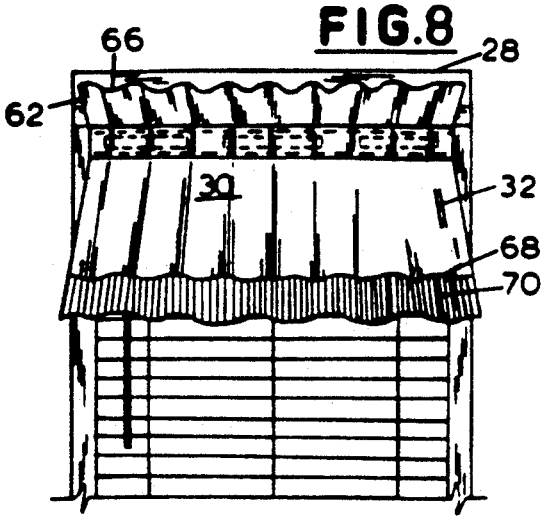
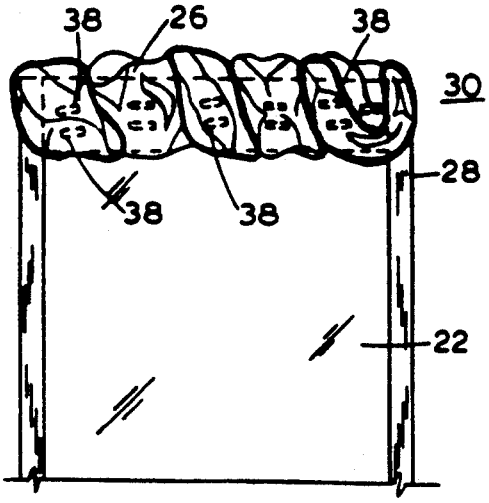
FIG.7
FIG.9
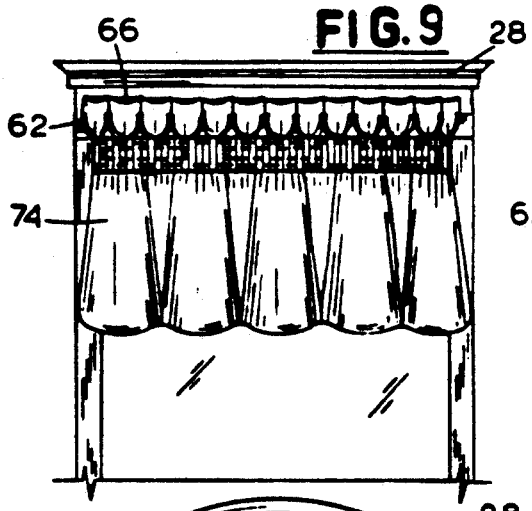
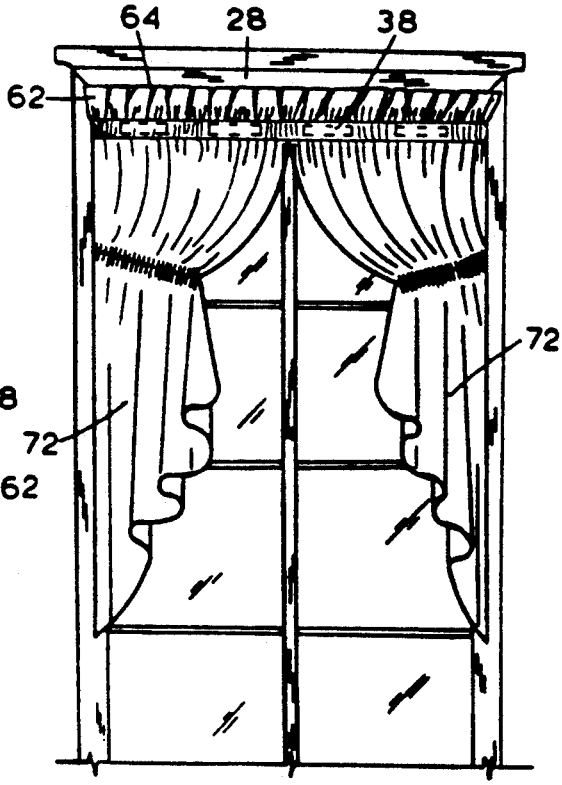
FIG.11
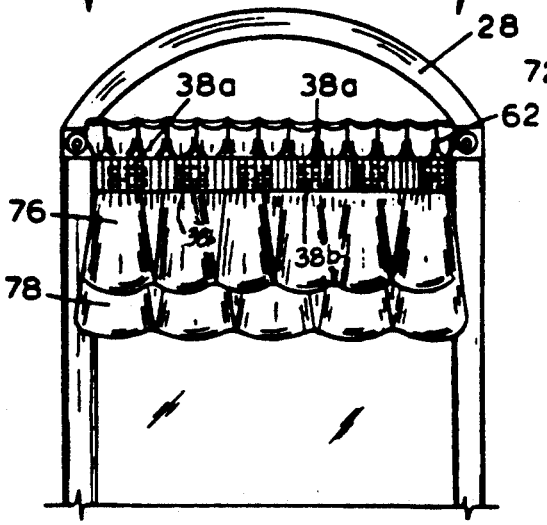
FIG.10

CURTAIN SYSTEM AND METHOD

BACKGROUND OF THE INVENTION

1. Field of the Invention

The invention relates to curtain systems and more particularly to an improved preshirred, adjustable decorative window treatment.

2. Description of the Prior Art

The prior art includes various curtain systems using invasive mounting structures for hanging a decorative window treatment around openings in a wall. The invasive mounting structure is attached to the wall or woodwork by hardware such as by using screws, brackets or molleys, which can damage the wall, leave permanent holes and other undesirable marks in a metal or expensive wood frame of a window. Furthermore, other more complex curtain systems can use multiple mounting structures that require additional time and labor for installation as well as these substantially increase the overall cost of the curtain system. Installation in other openings where a mounting surface is either absent or not wide enough to support mounting structures can cause other problems requiring additional installation expense or resort to custom-made mounting structures. Likewise, window treatments mounted within the perimeter of the window frame or casing such as inside mounted blinds and shades do not provide a good mounting surface for conventional mounting structures for hanging additional window treatments thereon such as when an inside mounted valance type treatment is desired.

In addition, several known curtain systems have used hook and mesh fastening material. A valance system is disclosed in U.S. Pat. No. 5,074,348 that uses hook and mesh fastening material rather than stapling or other hardware to attach and hang the segmented window treatment to the mounting structure such as a wood mounting board, curtain rod or drapery pole extending from a wall. The patent discloses a segmented window treatment of swags and festoons where these segments are arranged in an overlapped, end-to-end fashion thereby traversing the strip of the wood mounting board, rod or pole. Another foldable, non-fabric valance system is disclosed in U.S. Pat. No. 4,955,419 that is attached to the header for a blind or curtain. However, unlike these known curtain systems, the present invention provides a stretchable curtain system that can be mounted and hung to openings of various widths and without using additional mounting hardware and structures such as wood strips, curtain rods or drapery poles. Therefore, the development of an adjustable curtain system to accommodate different opening sizes without needing mounting structures or hardware would advance the state of the art.

SUMMARY OF THE INVENTION

It is an object of the present invention to provide an adjustable curtain system that overcomes many of the problems of the prior art.

In brief, the present invention provides a curtain system using a panel of fabric or sheet material with an upper edge, a lower edge and a pair of opposite ends. The panel is folded joining together the upper edge and panel in a seamed channel forming front and back panel segments with the seamed channel located in the back panel segment. An elastic material is secured to the back panel adjacent to the seamed channel. The elastic material gathers the panel providing shirring and an adjustable width for various sized openings in a wall. A hook and mesh fabric is secured adjacent to the seamed channel for mounting the panel to the wall or other window treatments around an opening The present invention provides a process for manufacturing an adjustable width valance system. An upper edge of a panel of fabric is folded to form front and back panel segments. The front and back panel segments are joined together in a seam along the upper edge. An elastic means is secured adjacent to the seam along the upper edge for shirring and adjusting the width of the panel of fabric. A hook and mesh fabric fastening material is attached adjacent to the seam along the upper edge for affixing the panel to a wall around an opening.

BRIEF DESCRIPTION OF THE DRAWING

These and other objects and advantages of the present invention will become readily apparent upon consideration of the following detailed description and attached drawing, wherein:

FIG. 7 is a front view illustrating an alternative braid-style using twisted pair of decorative valance treatments of the present invention;

FIG. 8 is a front view illustrating another embodiment of the decorative valance treatment of the present invention;

FIG. 9 is a front view illustrating another embodiment of the decorative valance treatment of the present invention;

FIG. 10 is a front view illustrating yet another embodiment of the present invention; and FIG. 11 is a front view of another embodiment of the present invention.

DETAILED DESCRIPTION OF THE DRAWINGS

Figure 1:
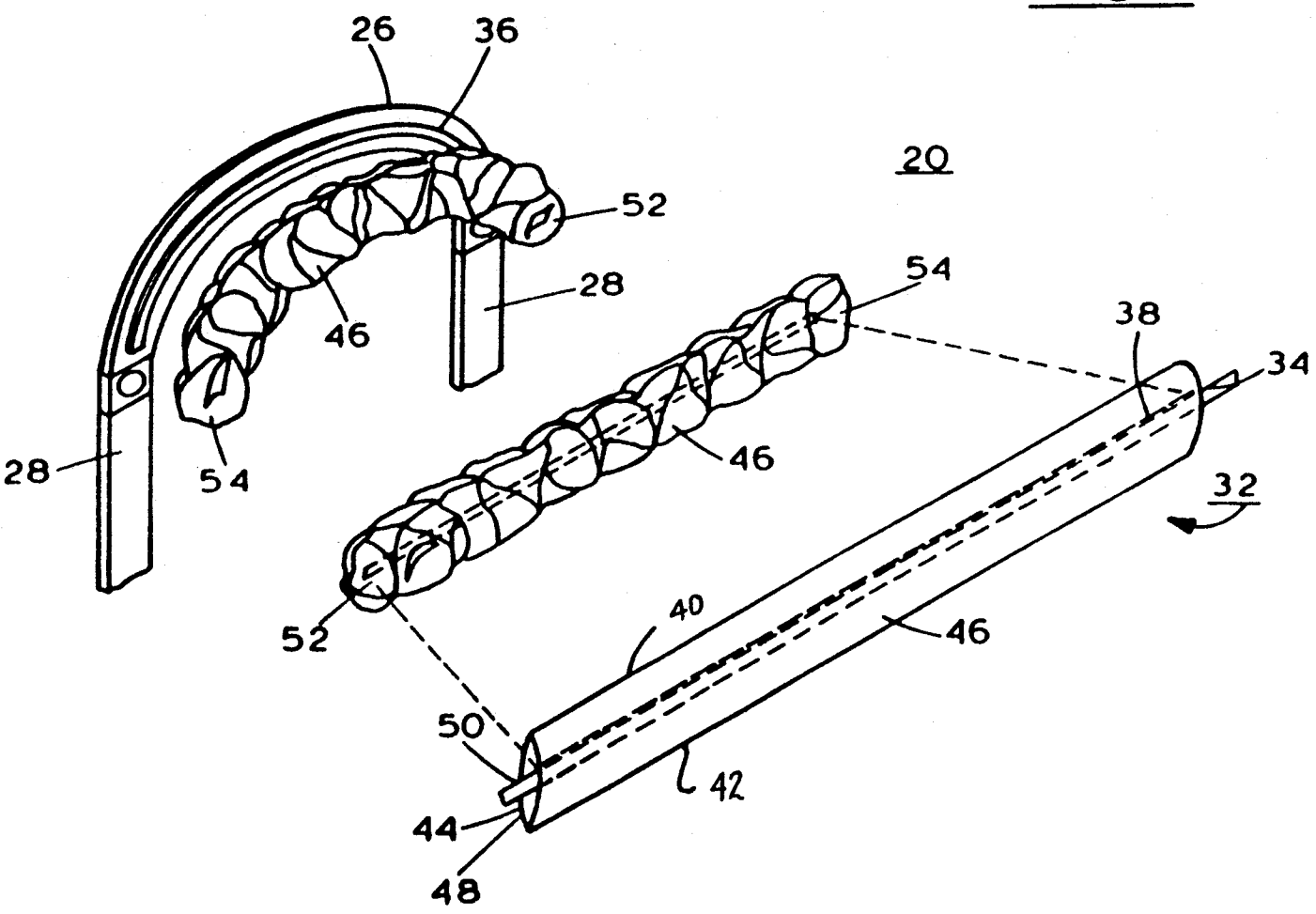
FIG. 1 is a schematic perspective view illustrating the curtain system of the present invention.

Referring now to the drawings, in FIG. 1 there is illustrated a curtain system generally designated by reference character 20 that is adjustable to suit any number of sizes and shapes of an opening in a wall or ceiling. Blind and pleated shade window treatments such as used in residences, commercial buildings, automobile, airplanes or boats, are mounted inside the perimeter of a frame forming the opening. The present invention will be generally described in terms of a valance type treatment applied to these inside mounted window treatments, but the present invention is not specifically limited to such, as other window treatments are contemplated. Furthermore, it is contemplated that the curtain system 20 of the present invention can be applied to other structures such as a border around a room, the perimeter of a canopy bed, baskets or the like. Through the following detailed description, the same reference numerals refer to the same elements in all figures.

Figures 2, 3, 4, 5A, 5B, 6A, 6B:
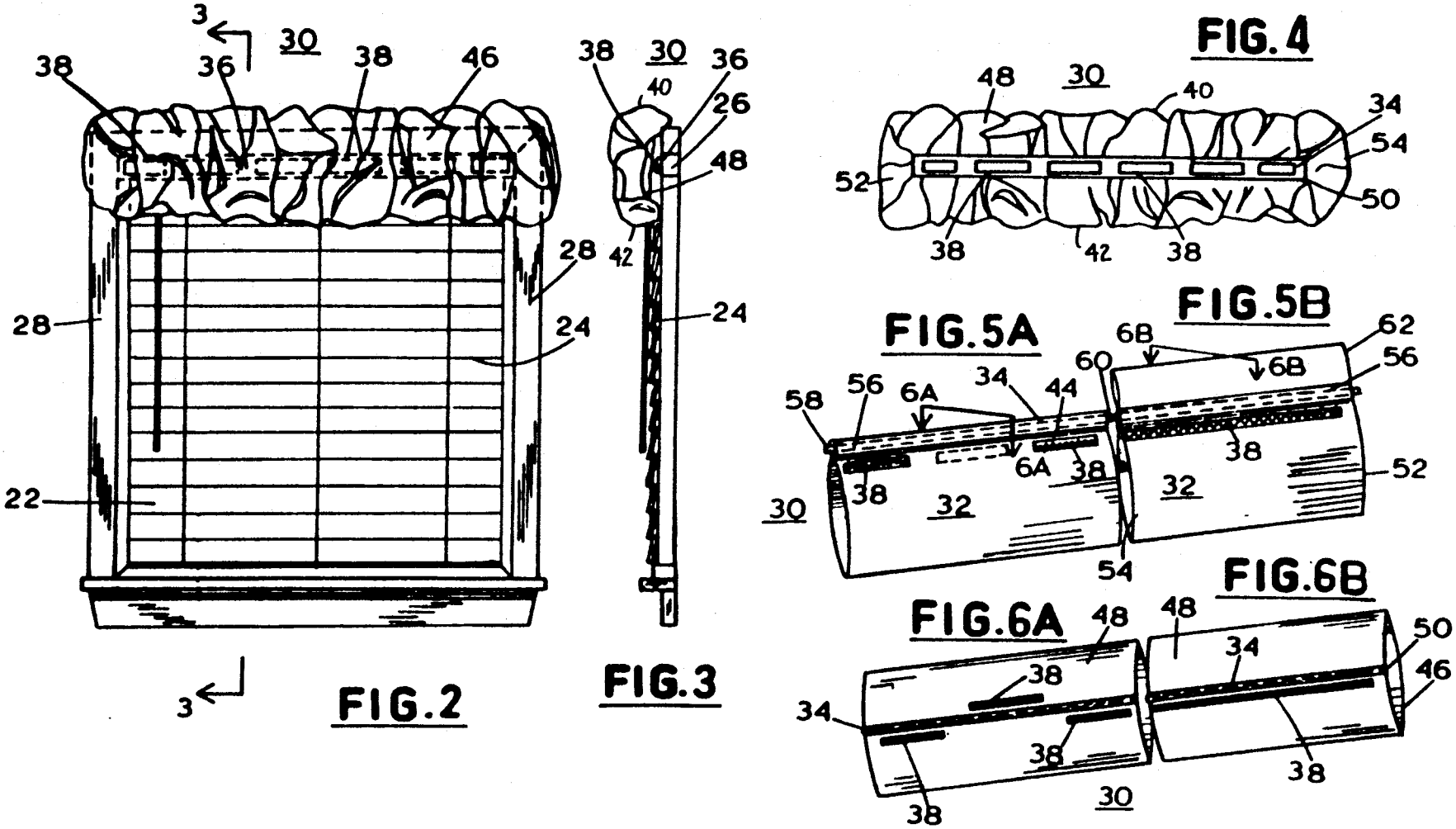
FIG. 2 is a front view illustrating the curtain system of the present invention mounted to an inside mounting surface, of a window treatment.
FIG. 3 is a side view, taken along lines 3—3 of FIG. 2, illustrating the curtain system of the present invention.
FIG. 4 is a rear view illustrating the decorative valance treatment of the present invention.
FIGS. 5A and 5B are schematic perspective views illustrating methods of forming the decorative valance treatment for a window.
FIGS. 6A and 6B are schematic views, taken along lines 6A—6A of FIG. 5A; and along lines 6B—6B of FIG. 5B, of the decorative valance treatment for a window.

As illustrated in FIGS. 1 and 2, a ruffled or poufed valance 30 for decorating a window 22 is shown. The window 22 has blind or shade 24 with a headrail 26 which can be mounted to the perimeter of a frame 28. The valance 30 includes a panel of fabric 32, an elongated elastic member 34, a strip of hook fabric 36 and a mesh fabric 38. The panel of fabric 32 can control the fullness or pouf of the valance 30 independent upon the type of decorative flexible sheet material used. For example, the fullness of the panel 32 can be controlled using heavier starched cotton fabric, lightweight silk fabrics having backing material secured thereto for increased fullness, or other techniques, materials or the like. Alternatively, fullness can be increased by increasing the amount of fabric in the width dimension.

As illustrated in FIGS. 1, 3 and 4, the valance 30 is formed by folding an upper edge 40 and a lower edge 42 forming a front and back portions 46 and 48, respectively. The upper and lower edges 40 and 42 are joined together at a seam 50 located at the back portion 48. The elastic member 34 can be stretched and secured adjacent to the seam 50 so as to shirr or gather together the opposite ends 52 and 54 of the back portion 48 of the panel 32. The mesh fabric 38 can also be secured adjacent to the seam 50 as either a segmented or as a unified strip (FIGS. 5A and 5B). The strip of hook fabric 36 can be a self-adhesive strip affixed to the headrail 26 or frame 28 of the window 22. The hook and mesh fabric 36 and 38, respectively, can be interchanged where, for example, hook fabric can be secured to the panel 32 and mesh fabric affixed to the frame 28.

The valance 30 is adjusted by manipulating panel 32 and can adjust to various other objects including widths of headrails 26 and shapes of windows 22 such as octagon or arched as shown in FIG. 1. The stretch of the elastic member is used to control the fullness Of the valance 30. The panel 32 can feature alternative constructions while retaining adjustability. As illustrated in FIGS. 5A and 6A, the panel 32 can be folded and joined by seam 50 to either the upper or lower edges 40 and 42. The remaining overlapping edge can be folding subsequently and joined to form a channel 56. The elastic member 34 is threaded through the channel 56, the panel 32 and elastic member 34 stretched, and the ends 58 and 60 secured to the opposing ends 52 and 54. In addition, as illustrated in FIGS. 5B and 6B, header segment 62 can be formed from the remaining overlapping edge which forms a decorative ruffle as shown in FIGS. 8, 9, and 11. Loops 64 or pleats 66 of various sizes can be formed in the header segment 62 using segments of the elastic member 34 staggeredly arranged along the header segment 62 and shirring the panel 32.

As illustrated in FIG. 7, two or more valance treatments 30 can be twisted or braided and attached to the headrail 26 or frame 28 of the window 22. Likewise, the opening of FIG. 7 can be a skylight where the strip of hook fabric 36 can be affixed to the blind or pleated shade installed thereon. The valance treatment 30 can be secured thereto without the problems of gravity and disadvantages of conventional mounting structures, hardware and installation. Here boats and airplanes have particular hanging problems associated with the constant turbulance of travel that are eliminated using the valance treatment 30. Furthermore, as applied to skylight openings, the valance 30 has a decorative poufed appearance without hanging problems of window treatments such as swags, festoons or the like.

As shown in FIG. 8, another embodiment of valance treatment 30 can be made. The panel 32 additionally includes a hem 68 or lace fabric 70. The hem 68 can alter the drop and be made in shapes other than a straight edge such as scallops or the like. Similarly, as shown in FIG. 11, the drop can be made angled and longer forming a festoon or side panel type treatment 72.

As shown in FIGS. 9 and 10 another embodiment of valance treatment 30 can be made. The panel of fabric 32 includes additional material forming a decorative balloon type valance treatment 74. Multiple balloon type valances 74 can be arranged slightly overlapping where the mesh fabric **38*a* of first treatment 76 having header segment 62 is attached to upper part of the strip of hook fabric 36. The second treatment 78 without the header segment 62 can be placed under the first treatment 76 and attached lower by mesh fabric 38*b*. In a similar manner, multiple layers of the valance treatment 30** of the present invention can be secured without the need for multiple mounting structures as in conventional complex curtain systems.

Obviously, many modifications and variations of the present invention are possible in light of the above teachings. Thus, it is to be understood that, within the scope of the appended claims, the invention may be practiced otherwise than as specifically described above.

What is claimed and desired to be secured by Letters Patent of the United States is:

1. A decorative valance for windows, skylights, doors or openings in a wall or the like, the decorative valance comprising:

a panel of decorative flexible sheet material having upper and lower edges, and a pair of opposite ends, said panel being folded and joined together in a seam at said upper and lower edges forming front and back panel segments with said seam located at said back panel segment;

elastic means secured to said back panel segment adjacent said seam for providing shirring of said panel and for adjusting a width of said panel;

hook and mesh fastening means for securing said panel to a facing surface of the wall, said means being secured adjacent said seam and affixed to said facing surface of the wall thereby securing said panel to the wall.

2. The decorative valance of claim 1 wherein said elastic means further comprising segmented portions secured to said back panel segment in spaced relation for shirring selectively said back panel segment.

3. The decorative valance of claim 1 wherein said upper edge and panel being folded and joined together in a seamed channel.

4. The decorative valance of claim 3 wherein said elastic means being disposed in said seamed channel and secured adjacent said opposite ends for shirring said back panel segment and creating a ruffled appearance on said front panel segment.

5. The decorative valance of claim 1 wherein said elastic means being an elongated elastic member secured and joined at said seam between said upper and lower edges.

6. A valance system for inside mounted window treatments comprising: the combination of a panel of fabric having front and back face segments, a strip of hook fabric, mesh means, and elastic means;

said hook fabric being attached to a front face of a mounting surface, said mesh mean being attached to said panel of fabric along said back face segment, and said elastic means being attached to said back face segment for shirring said panel of fabric and presenting a poufed appearance of said front face segment, whereby engaging said mesh means on said back face segment of said panel to said hook fabric located on said front face of said mounting surface adjustably secures said panel of fabric to said mounting surface.

7. The valance system of claim 6 wherein said poufed appearance results in said front face segment having a plurality of substantially continuous undulations of random depth over a surface area of said front face segment of said panel.

8. The valance system of claim 6 wherein said panel of fabric further includes upper and lower edges joined together forming a seam and a channel, and opposite end portions, said seam and channel being disposed on said back face segment, and said elastic means being threaded through and disposed in said channel and secured adjacent said opposite ends.

9. A curtain system kit for interior mounted window treatments, the kit comprising;

a panel of fabric having a front face, having opposite ends, upper and lower edges jointed together at a seam forming a channel and a back face, an elongated elastic means disposed in said channel and secured adjacent said opposite ends, and mesh means disposed adjacent said seam; and a strip of self-adhesive hook means;

said hook means being affixed to a facing surface of a mounting surface; whereby engaging said mesh means on said panel of fabric to said hook mans mounts the curtain system on said mounting surface.

10. A process of manufacturing an adjustable width valance, the process comprising the steps of:

folding an upper edge of a panel of fabric forming front and back panel segments;

joining said front and back panel segments together in a seam along said upper edge, said joining having a lower edge of said panel joined to said upper edge at said seam located on said back panel segment;

securing an elastic means adjacent to said seam along said upper edge; and securing fastening means adjacent said seam along said upper edge.

11. A process of claim 10 further including the step of:

joining a lower edge of said panel and said upper edge at said seam located on said back panel segment.

12. The process of claim 10 further includes the step of forming a channel adjacent said seam on said back panel segment;

threading said elastic means along in said channel; and securing said elastic means adjacent opposite ends of said panel of fabric.

13. The process of claim 10, further including the step of bonding said front and back panels together.

14. An adjustable width valance made by the process of claim 10.

15. An adjustable valance system for mounting to an opening in a wall, the valance system comprising:

a panel of fabric cut to a predetermined length, said panel having upper and lower edges and opposing ends said panel being folded and joined together in a seamed channel along said upper and lower edges, elastic means disposed and extending along said seamed channel of said panel and secured thereto adjacent said opposing ends; and fastening means secured adjacent to said seamed channel and affixed to a facing surface of the wall for mounting said panel to the wall.

16. The adjustable valance system of claim 15, wherein the dimension of said predetermined length being at least two times the length of said elastic means to provide a plurality of ruffled, poufed folds.

* * * * *